US009487881B2

(12) United States Patent
Ho et al.

(10) Patent No.: US 9,487,881 B2
(45) Date of Patent: Nov. 8, 2016

(54) APPARATUS FOR ELECTROPLATING A TOOLING FOR USE IN SEMICONDUCTOR DEVICE ENCAPSULATION

(75) Inventors: Shu Chuen Ho, Singapore (SG); Kai Fat Yip, Singapore (SG); Eng Cheng Chng, Singapore (SG); Yew Lan Ngo, Singapore (SG); Saravana Ranganathan Damodaran, Singapore (SG)

(73) Assignee: ASM TECHNOLOGY SINGAPORE PTE LTD, Singapore (SG)

( * ) Notice: Subject to any disclaimer, the term of this patent is extended or adjusted under 35 U.S.C. 154(b) by 1003 days.

(21) Appl. No.: 13/184,675

(22) Filed: Jul. 18, 2011

(65) Prior Publication Data

US 2013/0020193 A1 Jan. 24, 2013

(51) Int. Cl.

| | |
|---|---|
| ***C25D 5/02*** | (2006.01) |
| ***C25D 7/04*** | (2006.01) |
| ***C25D 17/12*** | (2006.01) |
| ***C25D 17/06*** | (2006.01) |
| ***C25D 1/02*** | (2006.01) |
| ***C25D 17/00*** | (2006.01) |

(52) U.S. Cl.

CPC ..... *C25D 17/001* (2013.01); *C25D 17/06* (2013.01); *C25D 17/12* (2013.01)

(58) Field of Classification Search

CPC ..... C25D 5/02; C25D 7/04; C25D 17/12; C25D 17/06; C25D 1/02

USPC ..... 204/242, 280, 285, 286.1, 297.01, 204/298.15

See application file for complete search history.

(56) References Cited

U.S. PATENT DOCUMENTS

| | | | | |
|---|---|---|---|---|
| 4,120,760 | A * | 10/1978 | Ueda | C25D 3/22 205/131 |
| 6,478,936 | B1 * | 11/2002 | Volodarsky et al. | 204/286.1 |
| 7,384,530 | B2 * | 6/2008 | Cohen et al. | 205/118 |

* cited by examiner

*Primary Examiner* — Zulmariam Mendez
(74) *Attorney, Agent, or Firm* — Ostrolenk Faber LLP

(57) ABSTRACT

An apparatus is disclosed for electroplating an inside wall of a transfer mold, the transfer mold being suitable for use in semiconductor device encapsulation. Specifically, the apparatus comprises a fixture, as well as a through-hole in the fixture for receiving an electrode to electroplate the inside wall of the transfer mold. In particular, the through-hole is configured to receive the electrode in a slide-fit to form a mutual interference fit for securing the electrode to the fixture. Upon fitting the electrode into the through-hole, the apparatus can then be used to electroplate the inside wall of the transfer mold by introducing the electrode into the space adjacent to the inside wall of the transfer mold. A device for use as an electrode in the apparatus is also disclosed.

15 Claims, 5 Drawing Sheets

APPARATUS FOR ELECTROPLATING A TOOLING FOR USE IN SEMICONDUCTOR DEVICE ENCAPSULATION

FIELD OF THE INVENTION

This invention relates to an apparatus for electroplating a tooling, which is particularly but not exclusively used as a transfer mold to encapsulate semiconductor devices. In particular, the apparatus is capable of electroplating an inside wall of the tooling.

BACKGROUND OF THE INVENTION

A transfer mold is typically used in the semiconductor industry to encapsulate a semiconductor device due to its high molding accuracy and low cycle time for conducting the encapsulation process. During the encapsulation process, a semiconductor device is clamped by the transfer mold while a molding material (e.g. epoxy resin) is injected through a runner. The molding material then flows from the runner through an opening (technically known as a 'gate') of the transfer mold to reach a molding cavity in which the semiconductor device is located. Encapsulation of the semiconductor device into a molded package subsequently takes place.

To adapt the transfer mold for use in semiconductor device encapsulation, an inside gate wall of the transfer mold has to be electroplated to prevent the molding material from adhering thereto. Otherwise, it will be difficult to remove the molding material from the inside gate wall of the transfer mold and a build-up of remnant molding material may result in blockage of the gate opening leading to the molding cavity, thereby affecting the encapsulation process.

Generally, it is not possible to coat the inside gate wall of the transfer mold by utilizing a conventional apparatus for the electroplating process. Due to the conical configuration and depth of the inside gate wall, the electric field generated by an electrical current will be stronger at the outer surface of the transfer mold and weaker at the inside gate wall.

Thus, it is an object of the present invention to seek to provide an apparatus that can be used to coat the inside gate wall of the transfer mold using general electroplating principles.

SUMMARY OF THE INVENTION

A first aspect of the invention is an apparatus for electroplating an inside wall of a transfer mold, the transfer mold being for use in semiconductor device encapsulation. Specifically, the apparatus comprises a fixture as well as a through-hole in the fixture for receiving an electrode to electroplate the inside wall of the transfer mold. In particular, the through-hole is configured to receive the electrode in a slide-fit to form a mutual interference fit for securing the electrode to the fixture.

By providing the through-hole that is capable of receiving the electrode in a slide-fit, the through-hole thus serves as a guide to direct the electrode accurately through the fixture in a slide-fit. Consequently, the fixture ensures a precise alignment of the electrode as it protrudes from the fixture, thereby preventing misalignment of the electrode. When the electrode is subsequently introduced into the space adjacent to the inside gate wall of the transfer mold during electroplating, any direct mutual contact between the electrode and the inner gate wall of the transfer mold is accordingly prevented.

Advantageously therefore, the fixture reduces the likelihood of damaging the gate of the transfer mold during electroplating.

Some preferred but optional features of the apparatus are defined in the dependent claims.

For instance, the through-hole may have a depth of more than 6 mm. This may ensure that a substantial portion of the electrode is guided by the through-hole through the fixture. Consequently, the through-hole may reduce the likelihood of the electrode deflecting away from its normal alignment as the latter protrudes from the fixture. This further reduces the risk of any direct mutual contact that may cause damage to the gate of the transfer mold. Advantageously, the fixture may further reduce the likelihood of damaging the gate of the transfer mold during electroplating.

In addition, the apparatus may further comprise at least one air-release slot to allow release of gases that are built up when the apparatus is in use to electroplate the transfer mold. By providing the air-release slot, the separation between the fixture and the transfer mold can be further reduced. This reduces the risk of the electrode deflecting away from its normal alignment as it protrudes from the fixture, and advantageously reduces the risk of any direct mutual contact that may cause damage to the gate of the transfer mold.

A second aspect of the invention is a device for use as an electrode in the apparatus according to the first aspect of this invention.

Preferably, the device is made of low carbon steel.

Preferably, the device comprises an annular shaft portion as well as a head portion protruding radially from the annular shaft portion.

BRIEF DESCRIPTION OF THE DRAWINGS

The preferred embodiment of the invention will now be described, by way of example only, with reference to the accompanying drawings of which.

DETAILED DESCRIPTION OF THE PREFERRED EMBODIMENTS

Figure 1:
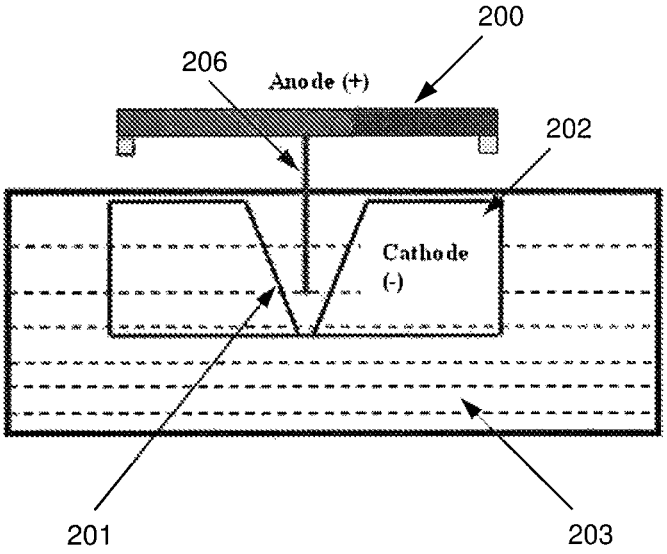
FIG. 1 is a schematic view showing a set-up of an apparatus according to the preferred embodiment of the invention during the electroplating process.

FIG. 1 shows a schematic set-up to increase an electric field around an inside wall of a gate 201 of a transfer mold 202 during the electroplating process. The set-up includes a coating fixture 200 according to the preferred embodiment of this invention. Specifically, the coating fixture 200 has an electrode 206 that is introduced to an interior space adjacent to the inside gate wall of the transfer mold 202. After the transfer mold 202 is immersed in an electrolyte 203 such as chromium nitrite, an electric field is then supplied between the coating fixture 200 and the transfer mold 202. Specifically, the transfer mold 202 acts as a cathode and is thus connected to a negative terminal of the electrical supply, whereas the coating fixture 200 acts as an anode and is thus connected to a positive terminal of the electrical supply. During the electroplating process, the metal element of the coating fixture 200 ionizes and corresponding metal cations accordingly move towards the transfer mold 202 to deposit a layer of chromium on the inside gate wall of the transfer mold 202.

Figure 2:
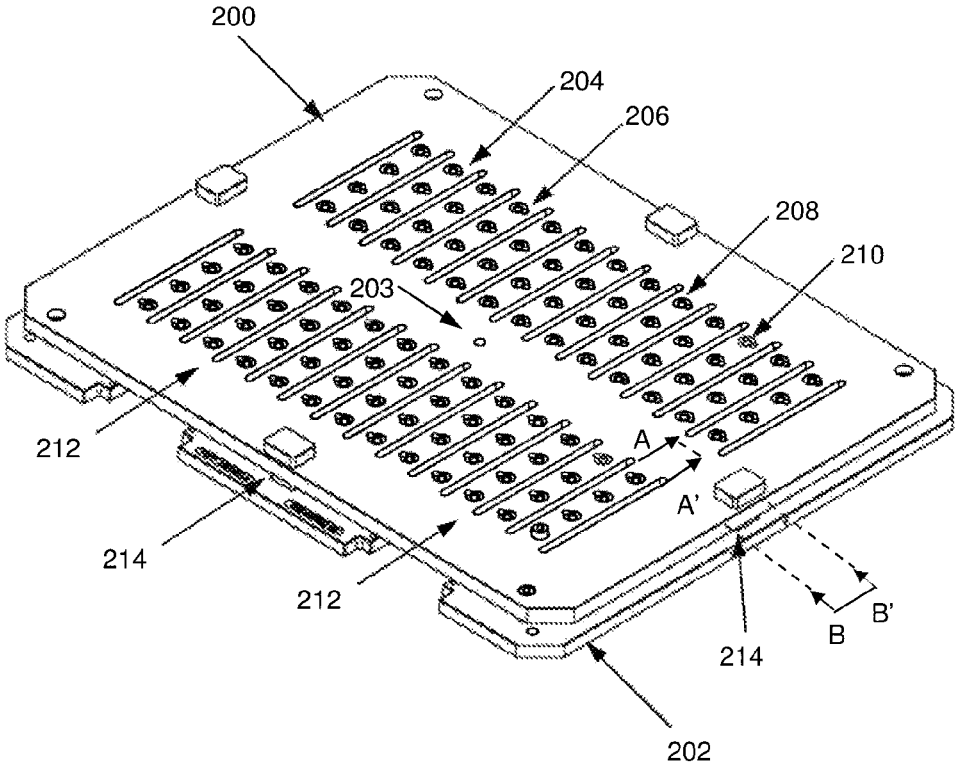
FIG. 2 is an actual view of the apparatus according to the preferred embodiment of the invention during the electroplating process.

FIG. 2 shows the coating fixture 200 during an electroplating process to electroplate the inside gate wall of the transfer mold 202 with a metal such as chromium before the latter is used in semiconductor device encapsulation. In particular, the coating fixture 200 defines a planar structure made of aluminum and includes a connecting point 203 for connecting to the positive terminal of the electrical supply (not shown). The coating fixture 200 also comprises a plurality of through-holes 204 into which respective electrodes 206 are introduced. Specifically, these electrodes 206 are introduced into respective interior spaces adjacent to the gate walls of the transfer mold 202 during the electroplating process. Preferably, the electrodes 206 are made of low carbon steel but they could also be made of other suitable materials.

In addition, the coating fixture 200 includes a plurality of bores (shown in FIG. 2 as screw bores 208) into which respective securing devices (shown in FIG. 2 as screws 210) are received. Once the screws 210 are screwed into the respective screw bores 208, they partially cover the through-holes 204 to prevent dislodgement of the electrodes 206 from the coating fixture 200.

The arrangement of the through-holes 204 on the coating fixture 200 depends on the arrangement of the gates 201 of the transfer mold 202. In FIG. 2, the through-holes 204 are generally divided into two columns, each column having multiple rows of through-holes 204 and each row having four through-holes 204.

Moreover, the coating fixture 200 includes a plurality of air-release slots 212, each arranged between adjacent rows of the through-holes 204, to allow the release of gases by passing them through the coating fixture 200 during the electroplating process. Further, the coating fixture 200 includes a plurality of stoppers 214 arranged at respective edges of the coating fixture 200 to ensure that the coating fixture 200 is maintained at a fixed distance from the transfer mold 202.

Figure 3:
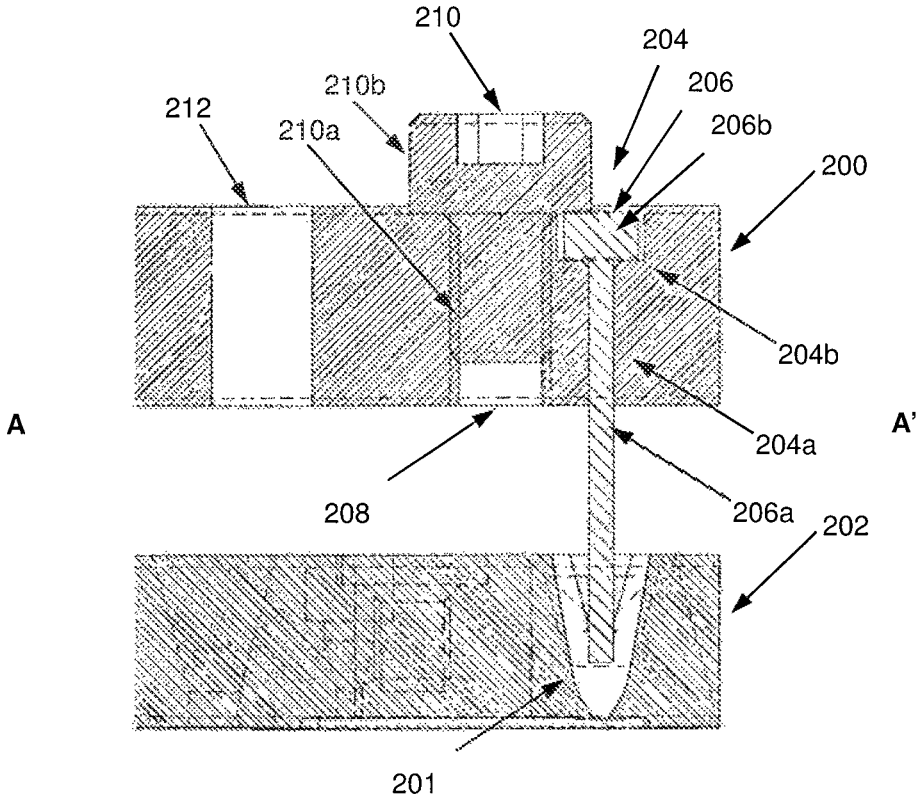
FIG. 3 is a close-up view of FIG. 2 when viewed along line A-A'.

FIG. 3 is a close-up view of the coating fixture 200 and the transfer mold 202 when viewed along line A-A' in FIG. 2. Specifically, the through-hole 204 of the coating fixture 200 comprises a uniformly annular bore 204*a* through which a uniformly annular shaft portion 206*a* of the electrode 206 is received. In particular, both the diameters of the annular bore 204*a* of the through-hole 204 as well as the annular shaft portion 206*a* of the electrode 206 are uniform. More specifically, the diameter of the annular bore 204*a* is slightly smaller than the diameter of the annular shaft portion 206*a* of the electrode 206. This means that the annular bore 204*a* of the through-hole 204 is slightly undersized, whereas the annular shaft portion 206*a* of the electrode 206 is slightly oversized. Accordingly, the annular bore 204*a* receives the annular shaft portion 206*a* of the electrode 206 in a slide-fit and forms an interference fit with the annular shaft portion 206*a* of the electrode 206 to secure the electrode 206 within the through-hole 204. The slide-fit of the electrode 206 into the through-hole 204 is akin to a 'press' fit, such that the electrode is retained in the through-hole 204 through frictional engagement. Accordingly, a pair of tweezers may be used for exerting a mechanical grip to pull the electrode 206 out of the through-hole 204.

Thus, the through-hole 204 serves as a guide to direct the annular shaft portion 206*a* of the electrode 206 accurately through the coating fixture 200 in a slide-fit motion. Consequently, the coating fixture 200 ensures a precise alignment of the electrode 206 as its annular shaft portion 206*a* protrudes from the coating fixture 200. When the annular shaft portion 206*a* of the electrode 206 is subsequently introduced into the interior space adjacent to the inside gate wall of the transfer mold 202 during electroplating, any direct mutual contact between the electrode 206 and the inner gate wall of the transfer mold 202 is thereby prevented. Advantageously therefore, the coating fixture 200 reduces the likelihood of damaging the transfer mold gate 201 during electroplating.

By contrast, other attachment means of securing the electrode 206 to the coating fixture 200 may result in deflection of the electrode 206 as the latter protrudes from the coating fixture 200. In such instances, the electrode 206 may be prone to direct contact with the inside gate wall of the transfer mold 202 due to their mutual proximity, thereby increasing the likelihood of damage of the transfer mold gate 201. Thus, if the electrode 206 were fixed to the coating fixture 200 via mating screw threads, one has to exercise much care when aligning its screw threads against corresponding internal screw threads of the coating fixture 200 since the electrode 206 is relatively long. Any misalignment of the screw threads of the electrode 206 against the corresponding internal threads of the coating fixture 200 may result in a direct mutual contact during electroplating, which may cause damage to the gate 201 of the transfer mold 202.

Preferably, the though-hole 204 of the coating fixture 200 has a depth of more than 6 mm. For instance, the through-hole 204 may have a depth of between 6.1 mm and 15.0 mm. This ensures that a substantial portion of the annular shaft portion 206*a* of the electrode 206 is guided by the through-hole 204 through the coating fixture 200 and retained therein via an interference fit. Consequently, the through-hole 204 may further reduce the likelihood of the electrode 206 deflecting away from its normal alignment as the latter protrudes from the coating fixture 200. This further reduces the risk of any direct mutual contact that may cause damage the gate 201 of the transfer mold 202. Advantageously therefore, the coating fixture 200 may further reduce the likelihood of damaging the gate 201 of the transfer mold 202 during electroplating.

Nonetheless, it should be appreciated that the through-hole 204 of the coating fixture 200 may also have a depth of between 7.0 mm and 14.0 mm, 8.0 mm and 13.0 mm, or 9.0 mm and 11.0 mm.

Additionally, the through-hole 204 of the coating fixture 200 comprises a counterbore 204*b* configured to engage with a head portion 206*b* of the electrode 206. Specifically, the head portion 206*b* of the electrode 206 protrudes radially from its annular shaft portion 206*a* and is therefore supported by the counterbore 204*b* of the through-hole 204. This effectively prevents further entry of the electrode 206 into the through-hole 204. Thus, the counterbore 204*b* of the through-hole 204 can be appropriately configured to ensure that the electrode 206 protrudes at a desired length from the coating fixture 200.

FIG. 3 also shows one of the screw bores 208 through which the screw 210 is received. Specifically, the screw bore 208 is located next to the through-hole 204. Like the electrode 206, the screw 210 includes a shaft portion 210*a* and a head portion 210*b* that protrudes radially from the shaft portion 210*a*. However, unlike the electrode 206 which is fastened within the through-hole 204 via an interference slide-fit, the screw 210 is instead fastened into the screw bore 208 via mating screw threads.

After the shaft portion 210*a* of the screw 210 is properly screwed into the screw bore 208, an underside of the head portion 210*b* of the screw 210 partially covers the opening of the through-hole 204 of the coating fixture 200. This prevents dislodgement of the electrode 206 from the coating fixture 200.

It should be appreciated that although FIG. 3 shows a partial covering of the opening of the through-hole 204 by the head portion 210*b* of the screw 210, it should be appreciated that the through-hole opening may be completely covered by a larger head portion 210*b* of the screw 210.

It should further be appreciated that other securing devices besides the screws 210 may also be suitable, so long as their respective head portions are capable of at least partially covering the through-holes 204 to prevent removal of the electrodes 206 from the coating fixture 200. For instance, such other securing devices may be introduced into corresponding bores 208 in a slide-fit and forming a mutual interference fit through frictional engagement.

Figure 4:
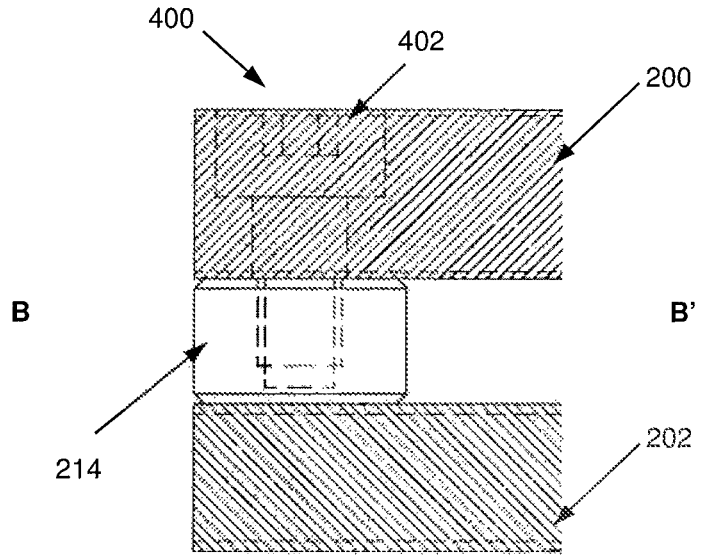
FIG. 4 is a close-up view of FIG. 2 when viewed along line B-B'.

FIG. 4 is another close-up view of the coating fixture 200 and the transfer mold 202 when viewed along line B-B' in FIG. 2. Specifically, FIG. 4 shows the view of one of the stoppers 214 arranged between the coating fixture 200 and the transfer mold 202 when they are located adjacent to each other during the electroplating process. As the stopper 214 is of a fixed thickness, it ensures that the coating fixture 200 is maintained at a desired fixed distance from the transfer mold 202 to prevent mutual direct contact of the electrode 206 with the gate 201 of the transfer mold 202.

In order to secure the stopper 214 to the coating fixture 200, a stopper bore 400 is provided on the coating fixture 200 through which an interlocking device (shown in FIG. 4 as a screw 402) interlocks between the coating fixture 200 and the stopper 214.

Nonetheless, it should be appreciated that other interlocking devices besides the screw 402 may also be suitable, so long as it achieves the function of securing the stopper 214 to the coating fixture 200. For instance, such other interlocking devices may be introduced into corresponding bores 400 in a slide-fit and forming a mutual interference fit through frictional engagement.

Preferably, the stopper 214 has a thickness of less than 12 mm. This further ensures that the annular shaft portion 206*b* of the electrode 206 does not deflect away from its normal alignment as it protrudes from the coating fixture 200. Accordingly, this further reduces the risk of the electrode 206 directly contacting the inside gate wall of the transfer mold 202 during the electroplating process. Advantageously therefore, the coating fixture 200 may further reduce the likelihood of damaging the gate 201 of the transfer mold 202 during electroplating. For instance, the stopper 214 may have a thickness of between 4.0 mm and 10.0 mm, 5.0 mm and 9.0 mm, or 6.0 mm and 8.0 mm.

It should of course be appreciated that the depth of the stopper 214 also depends on other dimensions such as the length of the electrode 206, the depth of the counterbore 204*b* of the through-hole 204, and so forth.

Preferably, the stopper 214 is made of polymer plastic but it could also be made of other suitable material.

Figure 5:
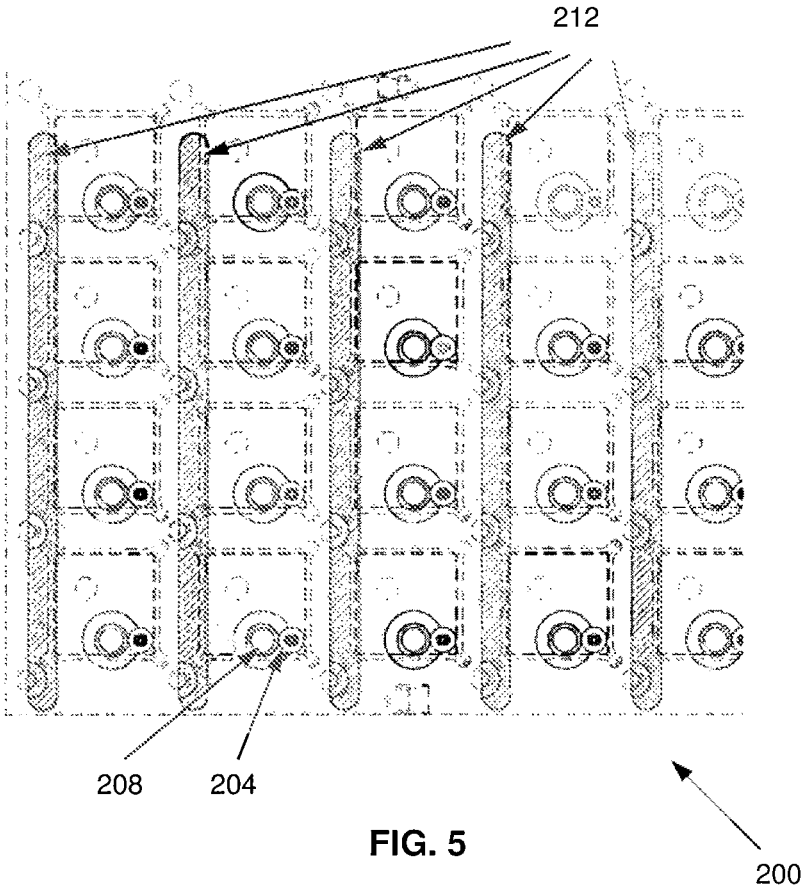
FIG. 5 is a plan view of the apparatus illustrated in FIG. 2.

FIG. 5 shows a plan view of a section of the coating fixture 200 of FIG. 2.

It can be seen that the air-release slots 212 are arranged between adjacent rows of the through-holes 204. As mentioned, the air-release slots 212 allow the release of gases that are built up through the coating fixture 200 during the electroplating process. By providing these air-release slots 212, the separation between the coating fixture 200 and the transfer mold 202 can be further reduced. This in turn reduces the risk of the electrodes 206 deflecting away from their normal alignments as they protrude from the coating fixture 200, and advantageously reduce the risk of their direct mutual contact that may cause damage to the gate 201 of the transfer mold 202.

It should be appreciated that various embodiments of the present invention are possible without departing from the scope and spirit of the present invention. For instance, although the air-release slots 212 are illustrated as slots arranged between adjacent rows of through-holes 204, it should be appreciated that a single air-release slot 212 may be provided on the coating fixture 200. Further, a single air-release slot 212 may be provided between two or more rows of through-holes 204. Yet further, other configurations of the air-release slots 212 that include regular and/or irregular shapes may also be possible so long as they serve the function of allowing the release of gases that are built up during the electroplating process.

In addition, although the coating fixture 200 has been described and illustrated as having a plurality of through-holes 204 for receiving respective electrodes 206, it should be appreciated that some embodiments of the coating fixture 200 may just include a single through-hole 204 for receiving an electrode 206. In such embodiments, the coating fixture 200 may just include a single screw bore 208 for receiving a screw 210 to prevent the electrode 206 that has been inserted into the through-hole 204 from being dislodged from the coating fixture 200.

The invention claimed is:

1. An apparatus for electroplating inside walls of a plurality of gates of a transfer mold, the transfer mold being for encapsulating semiconductor devices, the apparatus comprising:

a plurality of electrodes configured to act as anodes during electroplating, each electrode of the plurality of electrodes comprising:

a head portion; and a shaft portion configured to be inserted into a respective interior space of a gate of the transfer mold;

a fixture; and a plurality of through-holes in the fixture, each through-hole comprising:

a counterbore configured to engage with the head portion of a respective electrode to prevent further entry of the electrode into the through-hole; and a bore for receiving the shaft portion of the respective electrode configured to electroplate the inside wall of the respective gate of the transfer mold, wherein diameters of the bores of the through-holes are smaller than the diameters of the shaft of the electrodes, and the bores of the through-holes receive the shaft of the electrodes in a slide-fit to form a mutual interference fit to thereby secure the electrodes to the fixture, wherein the shaft portions of the electrodes are configured to protrude from the fixture.

2. The apparatus of claim 1, wherein each through-hole has a depth of more than 6 mm.

3. The apparatus of claim 1, wherein the fixture further comprises a bore located next to each through-hole, the bore being configured to receive a securing device so that a head portion of the securing device at least partially covers the through-hole to retain the electrode in the fixture.

4. The apparatus of claim 1, wherein the fixture further comprises at least one air-release feature configured to allow release of gases through the fixture.

5. The apparatus of claim 4, wherein the at least one air-release feature is a slot.

6. The apparatus of claim 5, wherein the slot has a width of 4 mm.

7. The apparatus of claim 1, further comprising a plurality of stoppers configured to separate the fixture at a fixed distance from the transfer mold.

8. The apparatus of claim 7, wherein the plurality of stoppers are arranged at respective edges of the fixture.

9. The apparatus of claim 7, wherein each of the plurality of stoppers has a thickness of less than 12 mm.

10. The apparatus of claim 7, wherein each of the plurality of stoppers is made of polymer plastic.

11. The apparatus of claim 7, wherein the fixture further comprises a plurality of stopper bores configured to receive respective threaded parts configured to secure the plurality of stoppers.

12. The apparatus of claim 1, wherein the fixture is made of aluminum.

13. The apparatus of claim 1, wherein the fixture defines a planar structure.

14. The apparatus of claim 1, wherein the fixture comprises a plurality of air-release features arranged between adjacent rows of the plurality of through-holes, the plurality of air-release feature being configured to allow release of gases through the fixture.

15. The apparatus of claim 14, wherein each of the plurality of air-release features is a slot.

* * * * *